US006640375B1

(12) United States Patent
Ruuska

(10) Patent No.: US 6,640,375 B1
(45) Date of Patent: Nov. 4, 2003

(54) BRUSH ASSEMBLY

(75) Inventor: Mauno Ruuska, Vammala (FI)

(73) Assignee: Patria Vammas Oy (FI)

( * ) Notice: Subject to any disclaimer, the term of this patent is extended or adjusted under 35 U.S.C. 154(b) by 331 days.

(21) Appl. No.: 09/677,892

(22) Filed: Oct. 3, 2000

(51) Int. Cl.[7] ..... E01H 1/02; E01H 1/04; A47L 13/00; A47L 11/00

(52) U.S. Cl. ..... 15/82; 15/78; 15/50.3; 15/52.1

(58) Field of Search ..... 15/82, 50.3, 52.1, 15/78, 49.1, 79.2

(56) References Cited

U.S. PATENT DOCUMENTS 2,330,025 A * 9/1943 Bentley et al. ..... 15/82
3,071,793 A * 1/1963 Hull ..... 15/82
4,926,517 A * 5/1990 Smith ..... 15/82
4,976,054 A * 12/1990 Jones ..... 37/235
6,269,560 B1 * 8/2001 Pratt ..... 37/408

* cited by examiner

*Primary Examiner*—Robert J. Warden, Sr.
*Assistant Examiner*—Laura C Cole
(74) *Attorney, Agent, or Firm*—Larson & Taylor, PLC

(57) ABSTRACT

A brush assembly is provided in a movable sweeper in which the sweeper includes a vehicle frame to which a rotatable cylindrical brush is connected. The sweeper comprises a turning equipment to turn a brush frame around the vertical axle. The turning equipment comprises a first hydraulic cylinder by means of which an articulated auxiliary bar is turned around its articulating joint. A second hydraulic cylinder is fixed to the auxiliary bar from one of its ends and the second hydraulic cylinder is fixed to the brush frame on its other end. The working positions of the brush are obtained by driving one of the hydraulic cylinders to its longest or correspondingly shortest position. A transporting position for the brush is obtained by driving the other one of the cylinders (first or second one) to its extreme position.

4 Claims, 2 Drawing Sheets

BRUSH ASSEMBLY

FIELD OF THE INVENTION

This invention relates to a brush assembly for a rotatable brush in a movable sweeper which is meant to work on large areas such as airport runways.

BACKGROUND OF THE INVENTION

Prior known sweepers have a rotatable cylindrical brush in which the sweepers have a rotation motor and a separate brush frame turnably mounted under the vehicle, i.e., sweeper frame. Conventionally, the brush frames have desirable working angles such as 35° or 40° wherein the brush is turned to throw particles either to the right or to the left in relation to the working or driving direction of the sweeper. Different brush angles are obtained by turning the brush frame around a vertical axle by means of a rotating motor and gear. Also a hydraulic cylinder is used to turn the brush frame to different brush angles. Brushes used in sweepers have very big breadths about 4–6 meters. The forces directing to the brush turning means may be substantial during the operation of sweeping and it follows that the turning means could be damaged easily. Moreover when turning the brush to a transporting position under the sweeper frame, the fixing points of one or more hydraulic cylinders have to be changed in order for the brush to be turned in the direction of the sweeper frame. Traditionally, adjustable sensors have been needed to adjust the angle positions of the brush in current brush turning equipment.

SUMMARY OF THE INVENTION

The brush assemblies with turning devices constructed according to this invention are easy to use, they are reliable and they can receive and tolerate large forces without becoming damaged. The present invention provides a remarkable improvement in the art compared with the prior sweepers.

The new turning equipment provides for the brush frame to have large turning angles, for example, at least 40° in both directions. The turning of the brush frame from one side to the other can be changed very quickly. The working angles of the brush frame are adjustable to be the same as the angles which are achieved by means of the extreme positions of the hydraulic cylinder in the turning equipment, i.e. by means of the longest and shortest positions. Transforming the present turning device to a transporting position can be done very easily only by driving, i.e., adjusting one hydraulic cylinder to its extreme position. Further, a sensor is not needed for limiting the turning angles of the brush. As a result, the brush frame is turned to either side easily and quickly. The cylinder lengths are selected or adjusted so that desired brush angles in both directions can be obtained. The transporting position of the brush in the direction of the vehicle frame is achieved by turning the brush further by means of a second cylinder using its shortest length.

BRIEF DESCRIPTION OF THE DRAWINGS

In the following the invention is more closely described by referring to the enclosed drawings, where.

DESCRIPTION OF THE INVENTION

Figure 1:
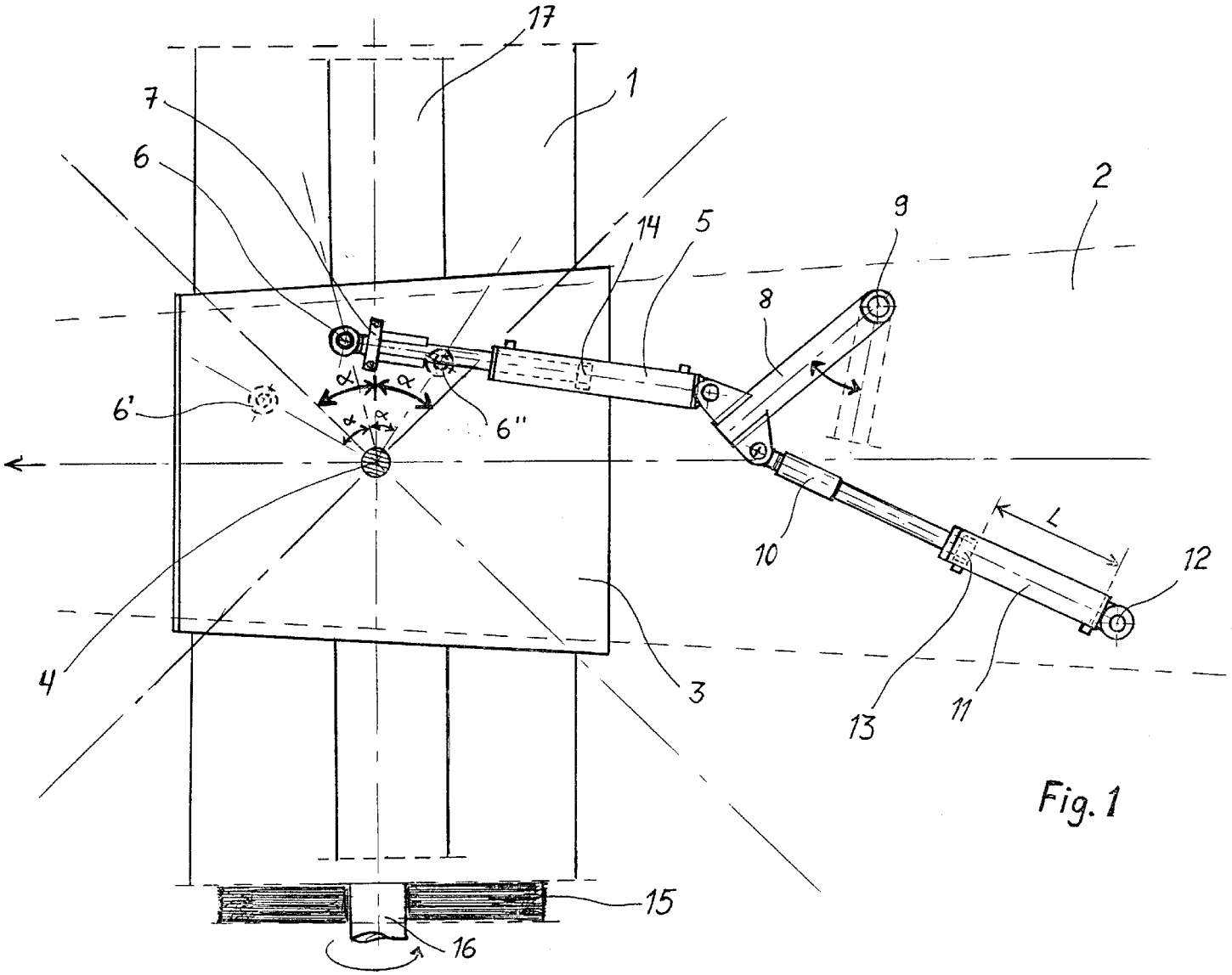
FIG. 1 is a top view of a brush frame and turning means of a sweeper.

FIG. 1 is a top view of a sweeper, which has an oblong vehicle frame 2 (broken line) in the working direction of the sweeper. A brush frame 3 and brush frame beam 17 are located under the vehicle frame 2. Brush axle 16 extends through brush frame beam 17 and brush axle 16 is supported in brush frame beam 17 by bearings (not shown).

A cylindrical brush 15 is mounted to axle 16 and preferable a hydraulic motor 18 (FIG. 2) provides rotation to the axle 16. A shield 1 is located above the brush 15 for preventing loose particles, water and snow from flying out. The brush frame 3 and brush frame beam 17 are fixed by means of a vertical axle 4 to the vehicle frame 2. The vertical axle 4 has bearings in the vehicle frame 2 allowing free rotation of vertical axle 4. Due to the free rotation of the vertical axle 4, the brush frame 3 and the brush frame beam 17 can be turned to angles a in both directions.

The brush turning equipment according to this invention is depicted in the FIG. 1. The turning device comprises first hydraulic cylinder 11 fixed to the sweeper vehicle frame 2 from its end by means of joint 12. The cylinder 11 has a piston 13 and piston rod. The piston rod comprises a threaded sleeve 10 on the piston rod by means of which the length of the piston rod can be adjusted. The motion distance of the piston rod of the cylinder 11 is distance L. The total length of the cylinder 11 can be adjusted by rotating the threaded sleeve 10 on the piston rod or by rotating a fixing eye screw inside the threaded sleeve 10.

An auxiliary bar 8 is pivotally connected on one end to the vehicle frame 2 by means of a joint 9, and the auxiliary bar 8 is connected on the other end to the first cylinder 11. The first cylinder 11 moves the auxiliary bar 8 about the joint 9.

A second cylinder 5 is pivotally fixed to the same end of the auxiliary bar 8 as the first cylinder 11 is attached. The cylinder 5 comprises a piston 14, a piston rod and motion limiting means 7,19 on the piston rod. The motion limiting means 7 includes a threaded sleeve for receiving a threaded screw of the motion limiting means 7. The piston rod is fixed to the brush frame 3 by a joint fixing eye 6. Cylinder 5 can be adjusted to a shortest total length by moving the motion limiting means 7 on the piston rod and fixing those on the proper point on the piston rod by pressing means. The motion limiting means 7 meet the end of the cylinder 5 in an adjustable position and limits the varying of the distance between the cylinder 5 and the fixing eye 6. Moreover as illustrated in the enlargement figure of FIG. 2, the piston rod comprises an extension by means of a screw 19 and threaded hole in the end of the piston rod wherein the length of the cylinder 5 can be adjusted by rotating the fixing eye 6 inside the threaded hole.

More desirable brush angles a can be selected by adjusting the length of the cylinder 5 so that the desired brush angles can be obtained in the position where the cylinder 5 is adjusted to its extreme position, i.e. to the shortest position for turning the brush to the right and to the longest position for turning to the left. When in operation, typically the brush is turned only either to the right to the extreme position or to the left to the extreme position. The other intermediate angles are not generally used.

The auxiliary bar 8 has a positive effect in turning when it moves the fixing point of the second cylinder 5 to a more preferable position in relation to the vertical axle 4 and the fixing eye 6. The lever arm transmitting the torque to the brush frame 3 and brush frame beam 17 becomes longer in all angle positions when using the auxiliary bar 8 in the manner described in FIG. 1. Further, the cylinder 11 will be adjusted to its longest position in the working or operational position of the brush.

When both cylinders 5,11 are adjusted to their extreme positions, the brush frame is then mechanically locked in the desired position in one direction and is hydraulically locked in the other direction. The turning equipment, the cylinders 5,11 and auxiliary bar 8 will then be better able to bear forces and strains.

Figure 2:
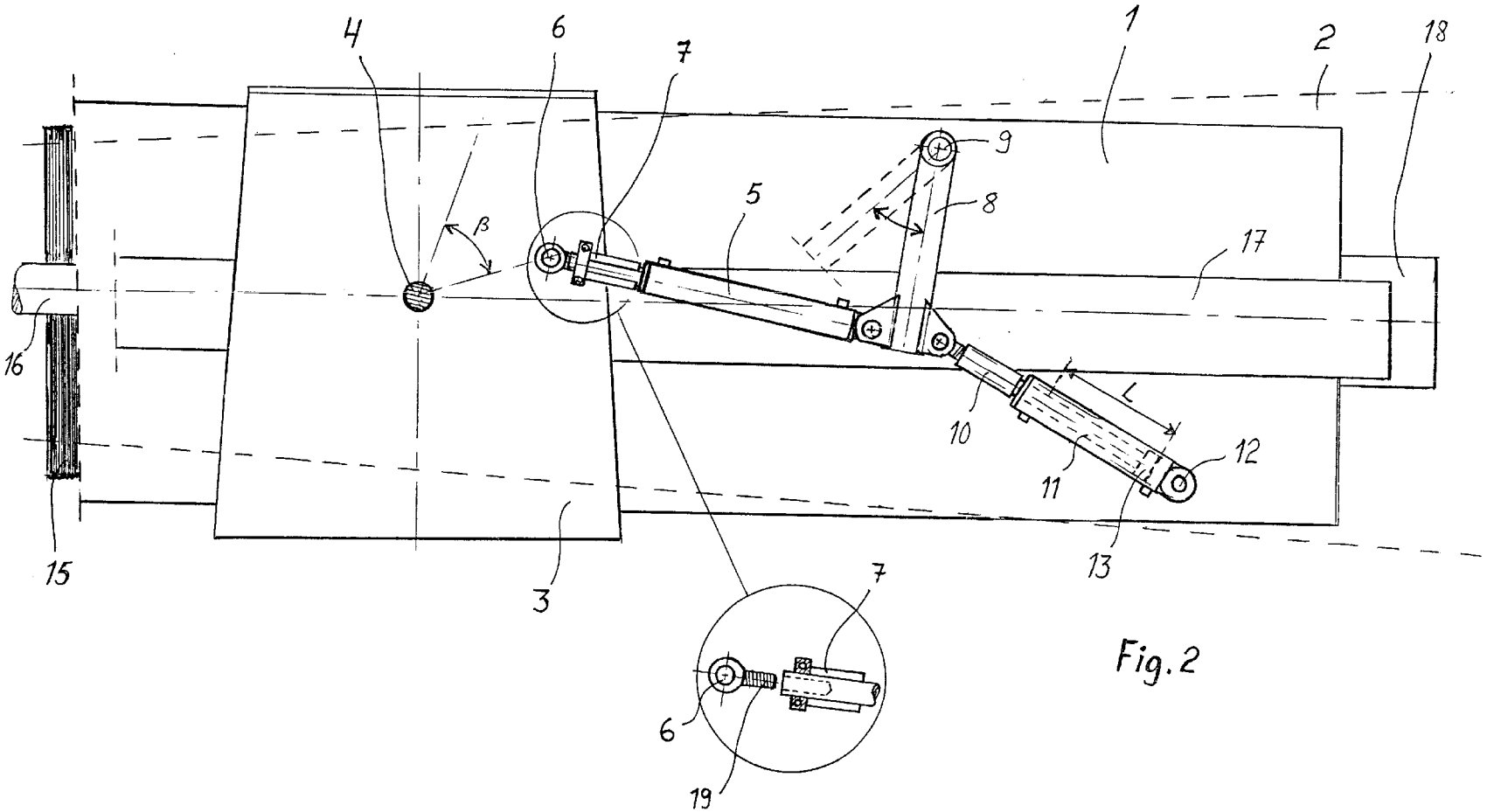
FIG. 2 is a top view of a brush frame in the transporting position.

FIG. 2 is a top view depicting where the brush is turned to a transporting position. The turning is carried out only by adjusting the cylinder 11 to its shortest position. Further, in FIG. 2, the cylinder 5 is adjusted to its shortest position, whereby the brush 15 now is positioned under the vehicle frame beam 2. Shortening the length of cylinder 11 assists in pulling the brush frame further under the frame beam 2 as demonstrated by an angle β in which the fixing eye 6 has been turned from location 6" (FIG. 1) to the location 6 depicted and described with respect to FIG. 2.

All operations: turning of the brush in both working angles as well as turning into transporting position are carried out by operating cylinders 5 and 11 separately or together to their extreme positions. As a result, cylinders 5,11 facilitate the working and use of the brush assembly. Also by means of the cylinder 11, the brush 15 can be turned to both working angles α, while by means of the cylinder 5, the brush is turned angle β into the transporting position.

Following herewith is a complete listing of the claims, including a marked copy of the currently amended claims:

1. A brush assembly in a movable sweepers, said sweeper having a vehicle frame to which a rotatable cylindrical brush is connected, said brush having a rotation axle, a rotation motor, a brush frame, a brush frame beam and a shield fixed to said brush frame beam to guide particles which are to be brushed, said brush frame being coupled to said vehicle frame with a vertical axle wherein said brush frame being able to be turned to throw, when rotating, the particles to the right or left in relation to a driving direction of the sweeper, said sweeper comprising a turning equipment to turn said brush frame around the vertical axle, said turning equipment comprising:

an articulated auxiliary bar having a first end fixed to said vehicle frame by a joint, a first hydraulic cylinder being fixed to said auxiliary bar by a first end of said first hydraulic cylinder and being fixed to the vehicle frame by a second end of said first hydraulic cylinder, a second hydraulic cylinder being fixed to said auxiliary bar by a first end of said second hydraulic cylinder and being fixed to the brush frame by a second end of said second hydraulic cylinder, wherein:

working position angles for said brush are obtained and maintained by driving one of said first hydraulic cylinders and second hydraulic cylinders to its longest or correspondingly shortest position, and a transporting position angle for said brush being obtained by driving the other one of said first hydraulic cylinder or second hydraulic cylinders to its extreme position.

2. A brush assembly according to claim 1, wherein said first hydraulic cylinder and second hydraulic cylinder are fixed to an end of said auxiliary bar opposite the end where said auxiliary bar is fixed to said vehicle.

3. A brush assembly according to claim 1, wherein a shortest total length of said first hydraulic cylinder can be adjusted by means of threaded extension means coupled to a piston rod of said first hydraulic cylinder.

4. A brush assembly according to claim 1, wherein the shortest total length of said second hydraulic cylinder can be adjusted by means of movable limiting means coupled to a piston rod of said second hydraulic cylinder.

* * * * *